US008777376B2

(12) United States Patent
Anderson et al.

(10) Patent No.: US 8,777,376 B2
(45) Date of Patent: Jul. 15, 2014

(54) SKEWED NOZZLE ARRAYS ON EJECTION CHIPS FOR MICRO-FLUID APPLICATIONS

(75) Inventors: Frank Edward Anderson, Sadieville, KY (US); Richard Earl Corley, Richmond, KY (US); Jiandong Fang, Lexington, KY (US)

(73) Assignee: Funai Electric Co., Ltd., Osaka (JP)

( * ) Notice: Subject to any disclaimer, the term of this patent is extended or adjusted under 35 U.S.C. 154(b) by 175 days.

(21) Appl. No.: 12/788,446

(22) Filed: May 27, 2010

(65) Prior Publication Data

US 2011/0292122 A1 Dec. 1, 2011

(51) Int. Cl.
*B41J 2/14* (2006.01)

(52) U.S. Cl.
USPC ..... 347/49; 347/42; 347/43

(58) Field of Classification Search
USPC ..... 347/42, 43, 49
See application file for complete search history.

(56) References Cited

U.S. PATENT DOCUMENTS

| | | | | |
|---|---|---|---|---|
| 8,118,405 | B2 * | 2/2012 | Xie et al. | 347/49 |
| 2004/0032452 | A1 * | 2/2004 | Serra | 347/40 |
| 2004/0080587 | A1 * | 4/2004 | Silverbrook | 347/85 |
| 2006/0066678 | A1 * | 3/2006 | Rai et al. | 347/54 |
| 2006/0227156 | A1 | 10/2006 | Silverbrook | |
| 2008/0055368 | A1 * | 3/2008 | Oikawa et al. | 347/62 |
| 2009/0135439 | A1 * | 5/2009 | Bates et al. | 358/1.8 |
| 2010/0058576 | A1 * | 3/2010 | Osaki | 29/593 |

OTHER PUBLICATIONS

"Memjet Printhead", www.memjetwideformat.com/technology/printhead/, 2 pp, printed May 27, 2010.

* cited by examiner

*Primary Examiner* — Justin Seo
(74) *Attorney, Agent, or Firm* — Amster, Rothstein & Ebenstein LLP

(57) ABSTRACT

A micro-fluid ejection head has multiple ejection chips joined adjacently to create a lengthy array across a media to-be-imaged. The chips have fluid firing elements arranged along skewed fluid vias to enable seamless stitching of fluid ejections. The firing elements are energized to eject fluid and ones are spaced according to colors or fluid types. Overlapping firing elements serve redundancy efforts during imaging for reliable print quality. Variable chips sizes and shapes are disclosed as are relationships between differently colored fluid vias. Skew angles range variously each with noted advantages. Singulating chips from larger wafers provide still further embodiments.

10 Claims, 10 Drawing Sheets

SKEWED NOZZLE ARRAYS ON EJECTION CHIPS FOR MICRO-FLUID APPLICATIONS

FIELD OF THE INVENTION

The present invention relates to micro-fluid ejection devices, such as inkjet printers. More particularly, although not exclusively, it relates to ejection heads having multiple ejection chips adjacently joined to create a lengthy micro-fluid ejection array or print swath.

BACKGROUND OF THE INVENTION

The art of printing images with micro-fluid technology is relatively well known. A permanent or semi-permanent ejection head has access to a local or remote supply of fluid. The fluid ejects from an ejection zone to a print media in a pattern of pixels corresponding to images being printed. Over time, the heads and fluid drops have become increasingly smaller. Multiple ejection chips joined together are also known to make large arrays, such as in page-wide printheads.

In large arrays, fluid ejections near boundaries of adjacent chips have been known to cause problems of image "stitching." That is, registration needs to occur between fluid drops from adjacent firing elements, but getting them stitched together is difficult especially when the firing elements reside on different substrates. Also, stitching challenges increase as arrays grow into page-wide dimensions, or larger, since print quality improves as the print zone narrows in width. Some prior art designs with narrow print zones have introduced firing elements for colors shifted laterally by one fluid via to align lengthwise with a different color near terminal ends of their respective chips. This, however, complicates chip fabrication. In other designs, complex chip shapes have been observed. This too complicates fabrication.

In still other designs, narrow print zones have tended to favor narrow ejection chips. Between colors, however, narrow chips leave little room to effectively seal off colors from other colors. Narrow chips also have poor mechanical strength, which can cause elevated failure rates during subsequent assembly processes. They also leave limited space for distribution of power, signal and other routing of lines.

Accordingly, a need exists to significantly improve ejection chips in larger micro-fluid arrays. The need extends not only to improving stitching, but to manufacturing. Additional benefits and alternatives are also sought when devising solutions.

SUMMARY OF THE INVENTION

The above-mentioned and other problems become with ejection chips having skewed nozzle arrays for micro-fluid applications. A micro-fluid ejection head has multiple ejection chips joined adjacently to create a lengthy array across a print media, also known as stationary page-wide printheads. The chips have skewed ink vias paralleling a skewed periphery to enable seamless stitching of fluid ejections. Each chip includes firing elements arranged along the vias that become energized to eject fluid and individual ones have spacing according to color. Overlapping firing elements serve redundancy efforts during imaging. Variable chips sizes and shapes are disclosed as are relationships between differently colored fluid vias. Fluid via lengths range from one-half to four mm and colors are adjacent across or down the chips. Representative skew angles range from five to eighty-five degrees with examples given for thirty and forty-five degrees. Singulating individual chips from larger wafers provide still further embodiments. Dicing lines, etch patterns and techniques are disclosed.

These and other embodiments will be set forth in the description below. Their advantages and features will become readily apparent to skilled artisans. The claims set forth particular limitations.

BRIEF DESCRIPTION OF THE DRAWINGS

The accompanying drawings incorporated in and forming a part of the specification, illustrate several aspects of the present invention, and together with the description serve to explain the principles of the invention. In the drawings.

DETAILED DESCRIPTION OF THE ILLUSTRATED EMBODIMENTS

In the following detailed description, reference is made to the accompanying drawings where like numerals represent like details. The embodiments are described in sufficient detail to enable those skilled in the art to practice the invention. It is to be understood that other embodiments may be utilized and that process, electrical, and mechanical changes, etc., may be made without departing from the scope of the invention. Also, the term wafer or substrate includes any base semiconductor structure, such as silicon-on-sapphire (SOS) technology, silicon-on-insulator (SOI) technology, thin film transistor (TFT) technology, doped and undoped semiconductors, epitaxial layers of silicon supported by a base semiconductor structure, as well as other semiconductor structures hereafter devised or already known in the art. The following detailed description, therefore, is not to be taken in a limiting sense and the scope of the invention is defined only by the appended claims and their equivalents. In accordance with the present invention, methods and apparatus include skewed ejection chips for a micro-fluid ejection head, such as an inkjet printhead.

Figure 1:
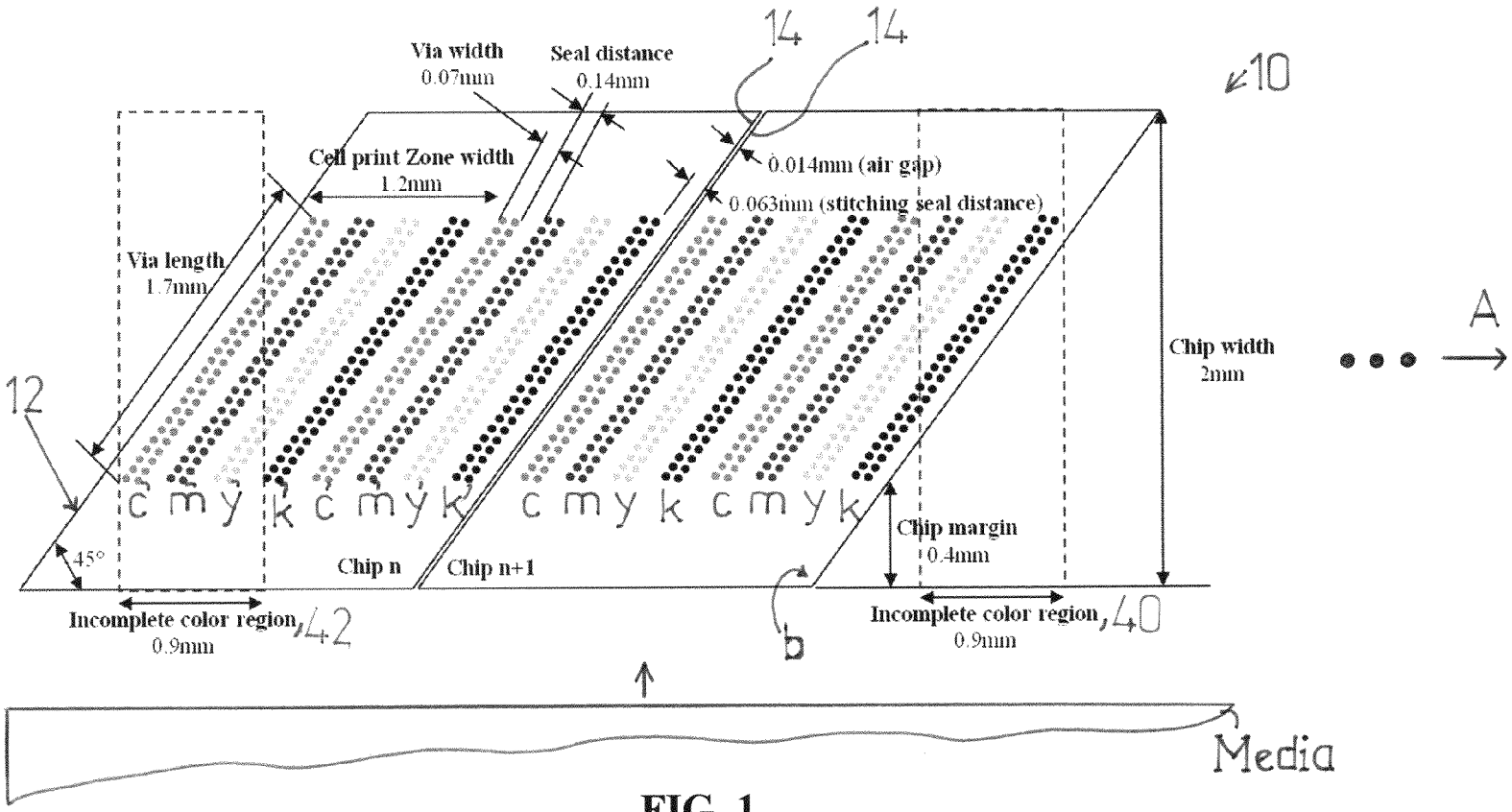
FIG. 1 is a diagrammatic view in accordance with the teachings of the present invention of a micro-fluid ejection head having multiple ejection chips having skewed nozzle arrays in an array.

With reference to FIG. 1, plural ejection chips n, n+1, . . . are configured adjacently in direction (A) across a media to-be-imaged. The micro-fluid array 10 includes as few as two chips, but as many as necessary to form a complete array. The array typifies variability in length, but two inches or more are common distances depending upon application. Arrays of 8.5" or more are contemplated for imaging page-wide media in a single printing pass. The arrays can be used in micro-fluid ejection devices, e.g., printers, having either stationary or scanning ejection heads.

Each chip includes pluralities of fluid firing elements (shown as darkened circles representing nozzles). The elements are any of a variety, but contemplate resistive heaters, piezoelectric transducers, or the like. They are formed on the chip through a series of growth, patterning, depositing, evaporating, sputtering, photolithography or other techniques. They have spacing along an ink via to eject fluid from the chip at times pursuant to commands of a printer microprocessor or other controller. The timing corresponds to a pattern of pixels of the image being printed on the media. The color of fluid also corresponds to the source of ink, such as those labeled C (cyan), M (magenta), Y (yellow), K (black).

In FIG. 1 the orientation of each chip is also skewed relative to the direction (A) of the array as it extends across the media. The skew angle is variable and five through eighty-five degrees are representative. A periphery 12 of the chip defines the actual angle and forty-five degrees is seen in this view. A planar surface of the periphery defines a shape of the chip. As seen, the periphery of each chip is a parallelogram in the form of a rhomboid such that the opposite sides of the quadrilateral parallel one another, but whose adjacent sides are unequal in length and meet at angles other than (90°) right angles. The short sides of the quadrilateral per each chip also parallel one another and parallel the direction (A) of the array as it extends across the media. Collectively, multiple such chips each have a rhomboid shape result in an array also having a rhomboid shape, but with longer opposite sides, i.e., the external peripheries of chips n and n+1 together define a rhomboid but the short sides of each chip accumulate in length to form a side of the collective rhomboid that is lengthier than any one chip. In turn, skew angles of each chip relative to the direction (A) of the array and skew angles of the collection of chips n, n+1, . . . relative to the direction (A) of the array are noted at angles other than right angles but have different measurement techniques depending on some or all of chip shape, where taken and how the ink vias are arranged. For example, a skew angle of 135° is obtained for a parallelogram if measured at location (b), verse the noted 45°, while an alternatively shaped periphery defining a polygon in the form of a chevron might be measured at an interior angle or at an exterior angle. Likewise, the fluid firing elements along an ink via might not parallel the chip periphery 12 and the skew may be defined according to the angular relationship of the via to the array direction. Regardless of how defined, later altering of the following equations may need to occur since they are based on geometry. Also, the figure teaches representative values for via length (1.7 mm), via width (0.07 mm), via seal distance (0.14 mm), stitching seal distance (0.063 mm), and a gap (0.014) whereby parallel edges 14 of chips define a boundary of adjacency. Based on these parameters, a design equation for seamless stitching between cell print zones of a single chip is given by the following equation:

$$\text{Via length} \times \text{Cos [skew angle]} = \text{Horizontal separation between same color vias} \quad \text{[Equation 1].}$$

A cell print zone width (1.2 mm) perpendicular to the skew via is denoted as:

$$\text{Cell print zone width} \perp \text{skew via} = \text{Via length} \times \text{Cos [skew angle]} \times \text{Sin [skew angle]} = \tfrac{1}{2} \times \text{Via length} \times \text{Sin [2} \times \text{skew angle]} \quad \text{[Equation 2].}$$

Figure 3:
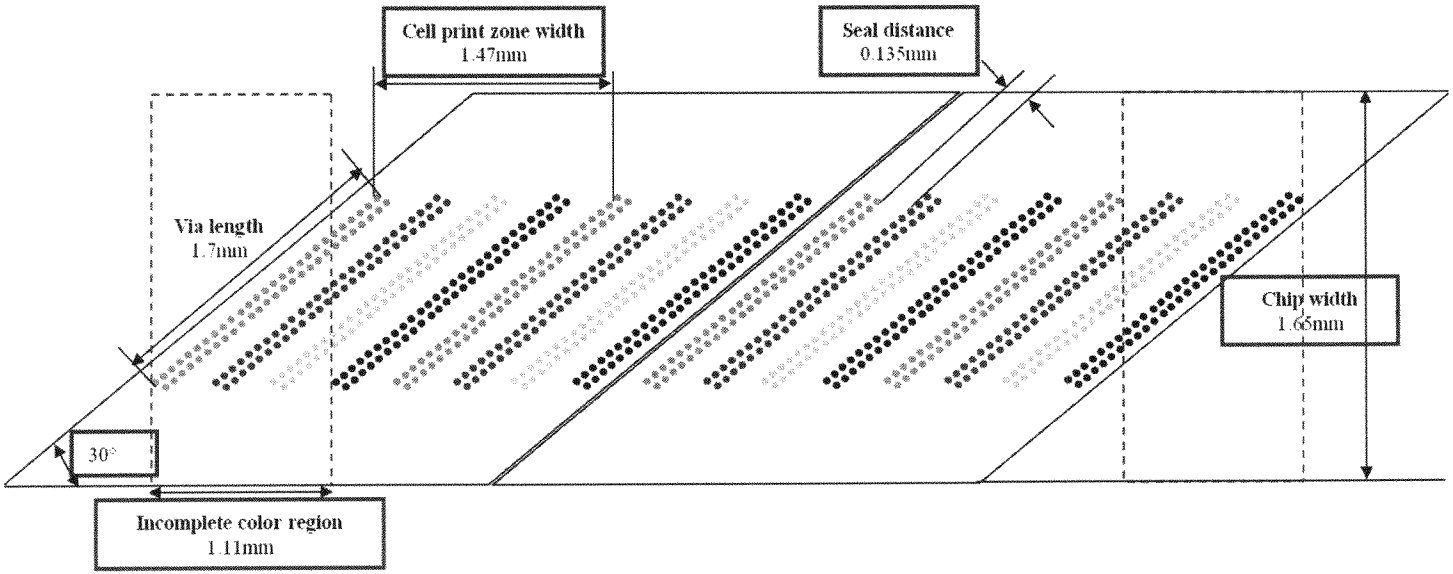
FIGS. 3-7 are diagrammatic views in accordance with the teachings of the present invention for various embodiments of a micro-fluid ejection head having multiple skewed ejection chips.
Figure 4:
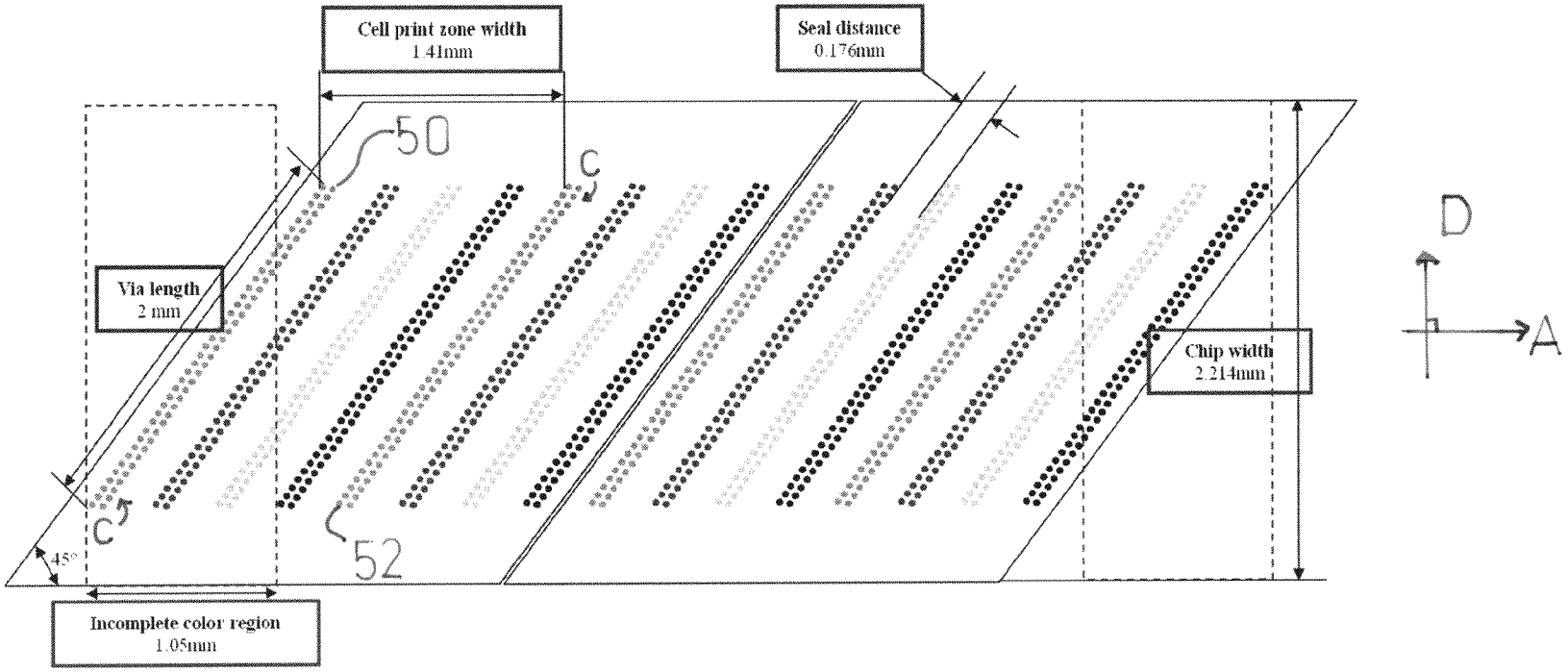
Figure 5:
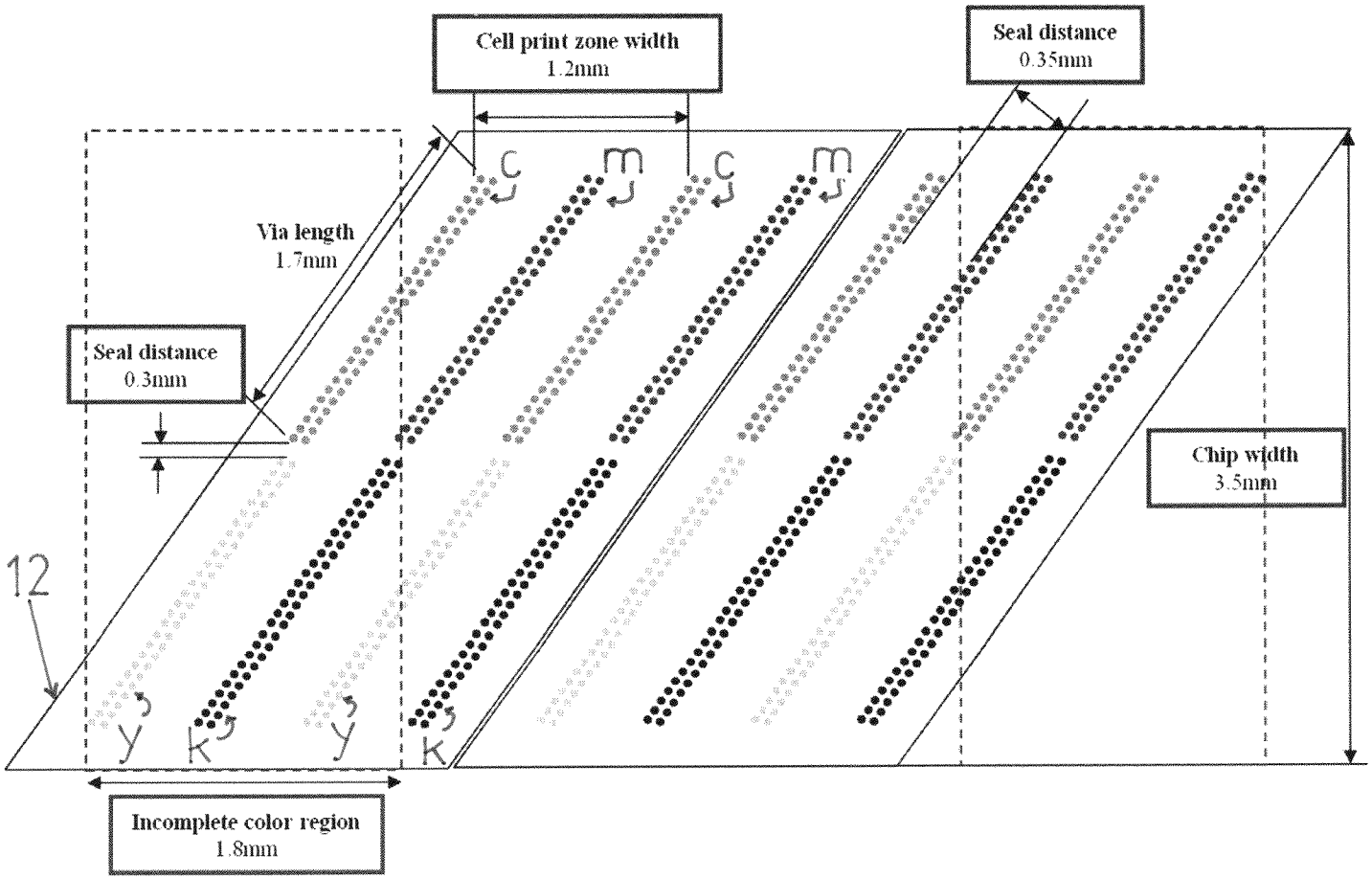

According to Equation 2, a via seal distance that is proportional to a cell print zone width, perpendicular to a skew via, can be altered by changing the skew angle, such as in FIG. 3, or via length as in FIG. 4. However, the maximum via seal distance exists at a skew angle of 45° for a given length of via and per a common arrangement of vias relative to one another. For example, an ink via length is representatively ranged from 0.5 mm to 2 mm in FIGS. 1, 3 and 4. The largest seal distance (0.14 mm) occurs for a skew angle of forty-five degrees for a via length of 1.7 mm (FIG. 1). A seal distance of 0.135 mm occurs for a similarly lengthy via in FIG. 3, but at a skew angle of thirty-degrees. To further extend the via seal distance, additional embodiments contemplate the configuration shown in FIG. 5. In this design, the ink via length is maintained at 1.7 mm, for a skew angle of forth-five degrees, but firing elements of adjacent colors are shifted from all being adjacently parallel one another across the media to one or more colors Y, K extending in line parallel with the periphery 12 with other colors C, M, respectively. In such a design, the seal distance can be extended to reach 0.35 mm or more.

Figure 6:
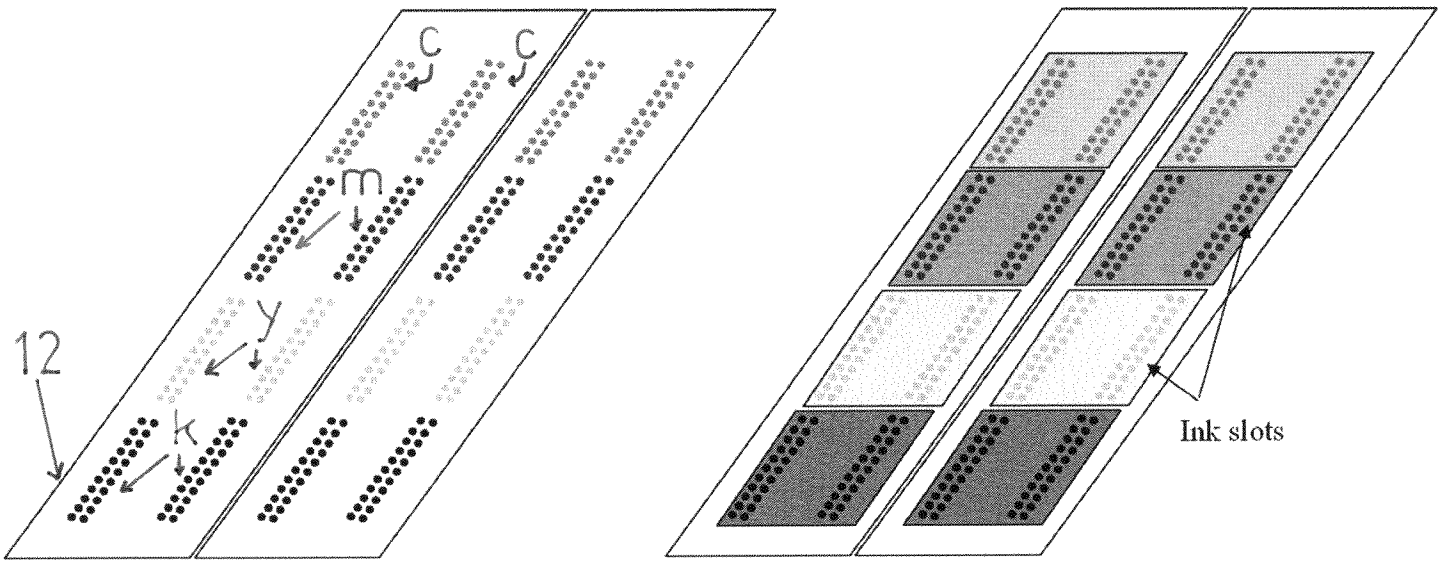

Of course, the size of the seal distance contributes to mechanical strength of a chip since the more structure that exists between adjacent ink vias the stronger the chip. Also, the more the structure that exists, the more room that is available for actions involving the dispensing of adhesives, bonding the ejection chip to other structures, laminating the seal area, or the like. On the other hand, extending the seal distance comes at the expense of chip width growing from 2 mm in FIG. 1, to 3.5 mm in FIG. 5. Alternatively still, FIG. 6 shows firing element configurations with but a single color adjacently parallel across the media and all remaining colors residing in-line with one another along the periphery 12. In this instance, the seal distance is as wide as the separation between any two ink vias of a similar color.

Figure 2:
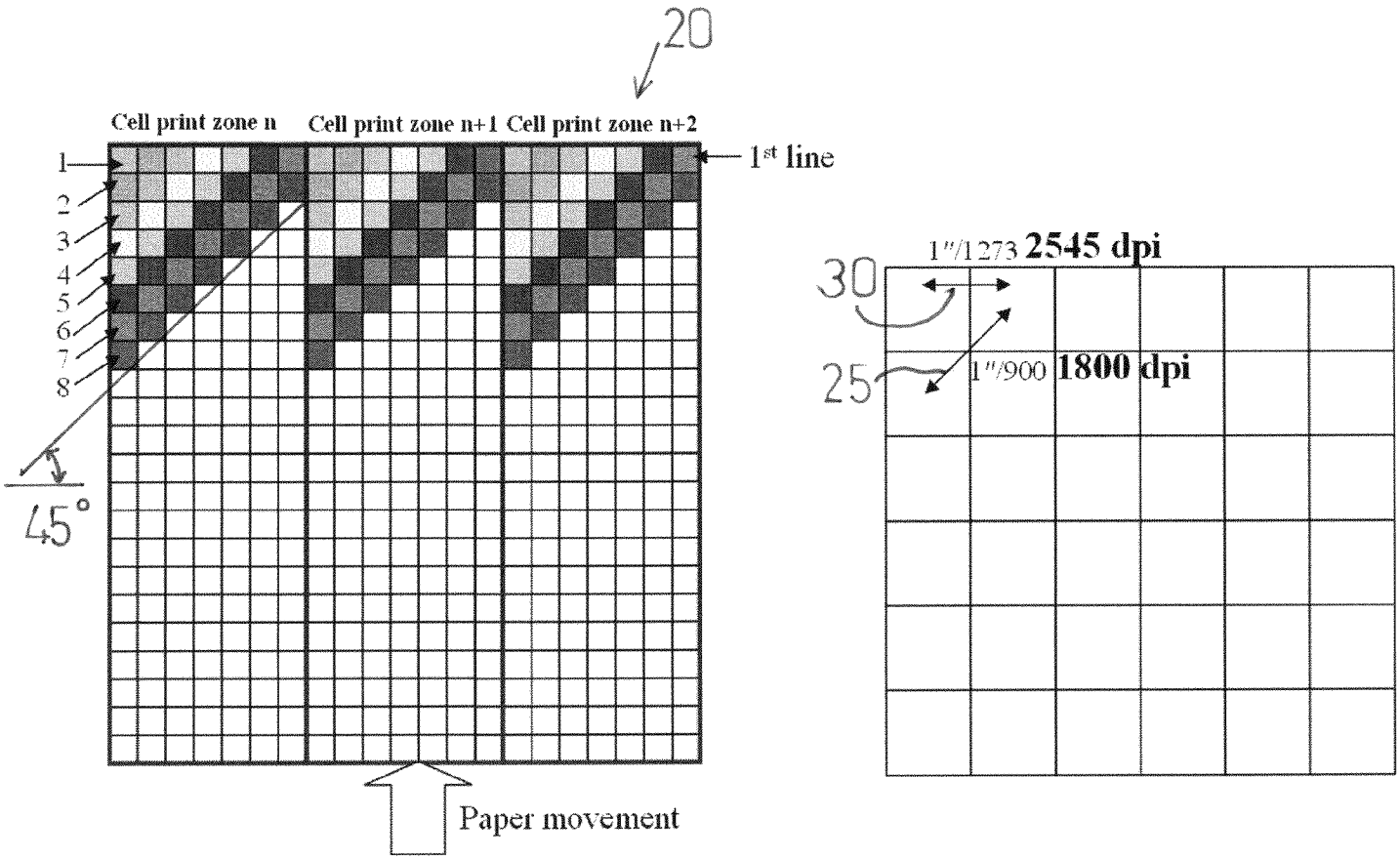
FIG. 2 is a diagrammatic view in accordance with the teachings of the present invention showing improved imaging resolution.

With reference to FIG. 2, a print sequence of an ejection chip having a 45° skew angle and ink vias arranged as CMYK is given as 20. As media advances in a paper movement direction transverse to the direction of the micro-fluid array, a single ejection chip n, n+1, n+2, etc. has multiple CMYK cell print zones 1-8. A front line of those zones proceeds on the media at a 45° skew angle as seen. To the extent the fluid firing elements are evenly spaced at a dimension (a), such as $1/1900^{th}$ of inch distance along the via parallel to the skew (bidirectional arrow #25), an 1800 dpi (dots per inch) nozzle arrangement translates into a square 2545×2545 dpi imaging resolution when affixed on the media (bidirectional arrow #30). Similarly, an even nozzle spacing and 30° skew angle will result in a non-square resolution of 2081 dpi×3600 dpi. Other spacing of nozzles includes $1/300^{th}$, $1/600^{th}$, $1/1200^{th}$, $1/2400^{th}$, etc. The method for calculating the horizontal and vertical resolutions on media are improved by a factor of $\sqrt{2}$ dpi over the nozzle spacing arrangement on a given ejection chip. The equation is given as:

$$\text{dpi media resolution} = \{2/a \times \text{Sec[skew angle]}\} \times \{2/a \times \text{Csc[skew angle]}\} \quad \text{[Equation 3].}$$

Figure 7:
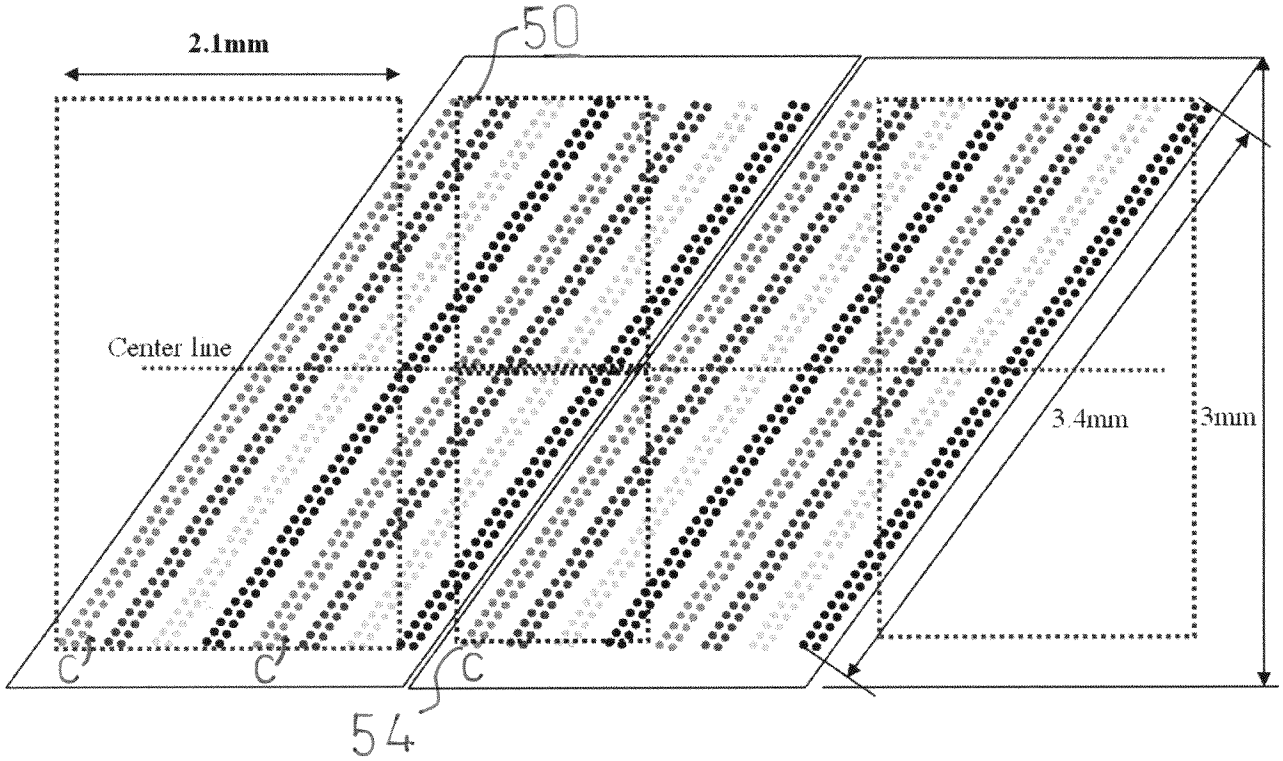

With reference to FIGS. 1, 3, 4 and 5, an incomplete color region is identified in the micro-fluid array. This region corresponds to instances where no overlap exists of firing elements for individual groupings of colors C, M, Y, or K, in the direction transverse to direction (A). As such, imaging a media in this region might be intentionally avoided. The regions 40, 42, also exist on either side of the micro-fluid array. To the interior of these regions, on the other hand, full color imaging is possible as overlap exists of firing elements for all groupings of color. As seen in FIG. 4, firing elements 50 and 52 overlap one another in the direction labeled (D) for the color corresponding to cyan (c). Similarly, at least one firing element overlaps another for each of the colors yellow, magenta and black. With reference to FIG. 7, the overlap can occur multiple times. The overlap occurs for firing elements of the cyan color (c) at positions 50 and 52, as before, but again as between firing elements 50 and 54 or 52 and 54. (Firing element 52 is not labeled in FIG. 7 for want of adequate space, but appears at the intersection with the Center line.) In addition, overlapping elements provides nozzle redundancy which improves print quality and reliability in stationary printheads. If a single nozzle had no overlap and it were otherwise obstructed or prevented from firing, a print defect in the form of a vertical space would appear in the media. Double overlapping elements can also improve imaging resolutions.

Figure 8:
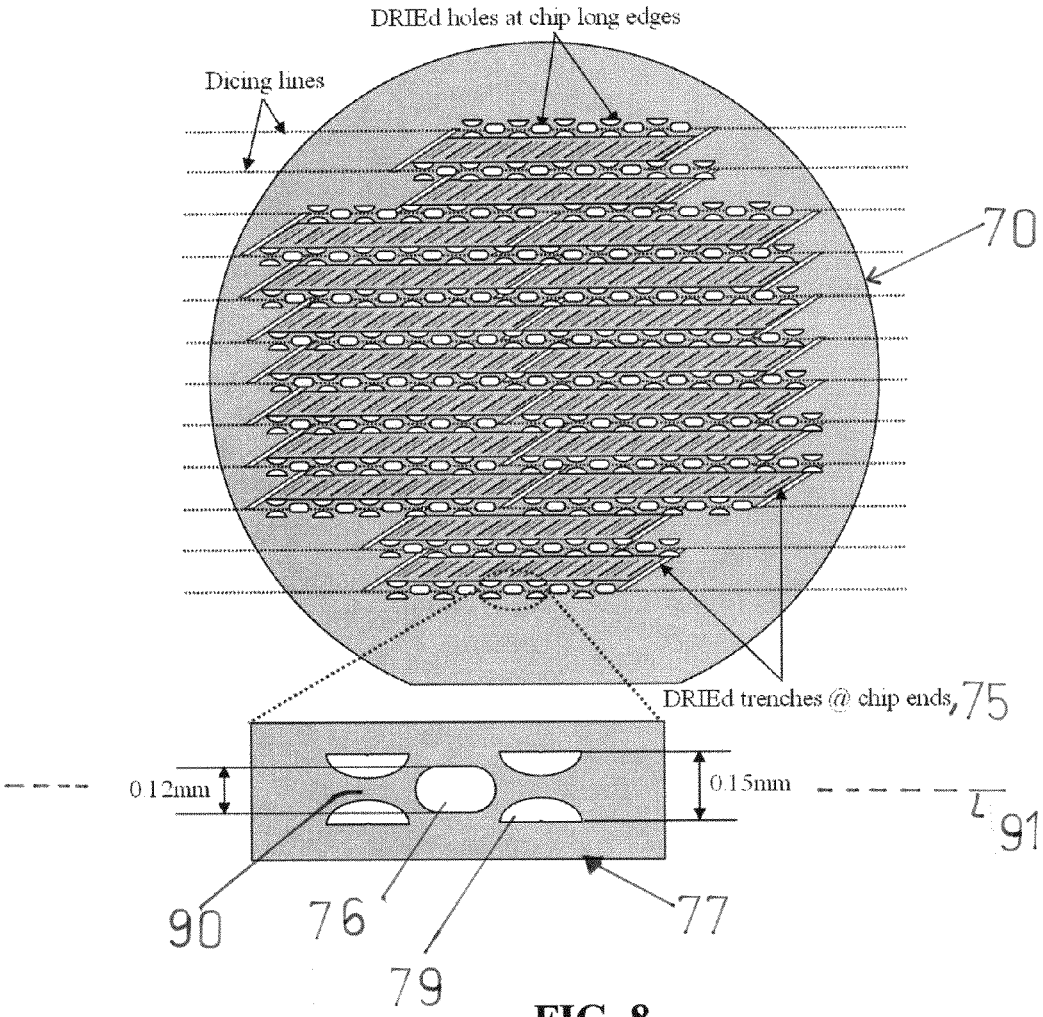
FIG. 8 is a diagrammatic view in accordance with the teachings of the present invention showing singulation of ejection chips from a wafer.

With reference to FIG. 8, singulating individual chips from a large wafer 70 includes methods to achieve high yields with much higher fragility than conventional chips. For a single crystal silicon wafer, cracks favor propagation in crystal planes, especially at <111> crystal planes. Thus, a processed wafer is preferred to be a <100> silicon wafer. It may typify p-type having a resistivity of 5-20 ohm/cm. Its beginning thickness can range from about 200 to 800 microns or other.

In any wafer, skew vias 75 are etched by DRIE (deep reactive ion etching) or other processes at chip ends. Along the edges of the chips, a hole pattern 77 is formed by the same etching step. The pattern consists of interleaved full and half-patterned holes 76, 79. The wafer is mechanically diced at the lowest cost to individual chips along horizontal lines 91. Dicing blade thicknesses are assumed to be 0.1 mm, therefore, only the solid part 90 between two holes will be diced when the dicing blade is aligned with the centers of the full holes 76. In this manner, all cracks introduced by the dicing process are bounded by the holes. In addition, the etched holes along the horizontal dicing streets greatly reduce dicing slurry from contaminating concurrently formed nozzle plates. Skilled artisans will also observe that the shapes of the chips are relatively simple compared to the complex shapes in the prior art. In turn, the introduction of dicing when the prior art has none greatly simplifies singulation.

Figure 9:
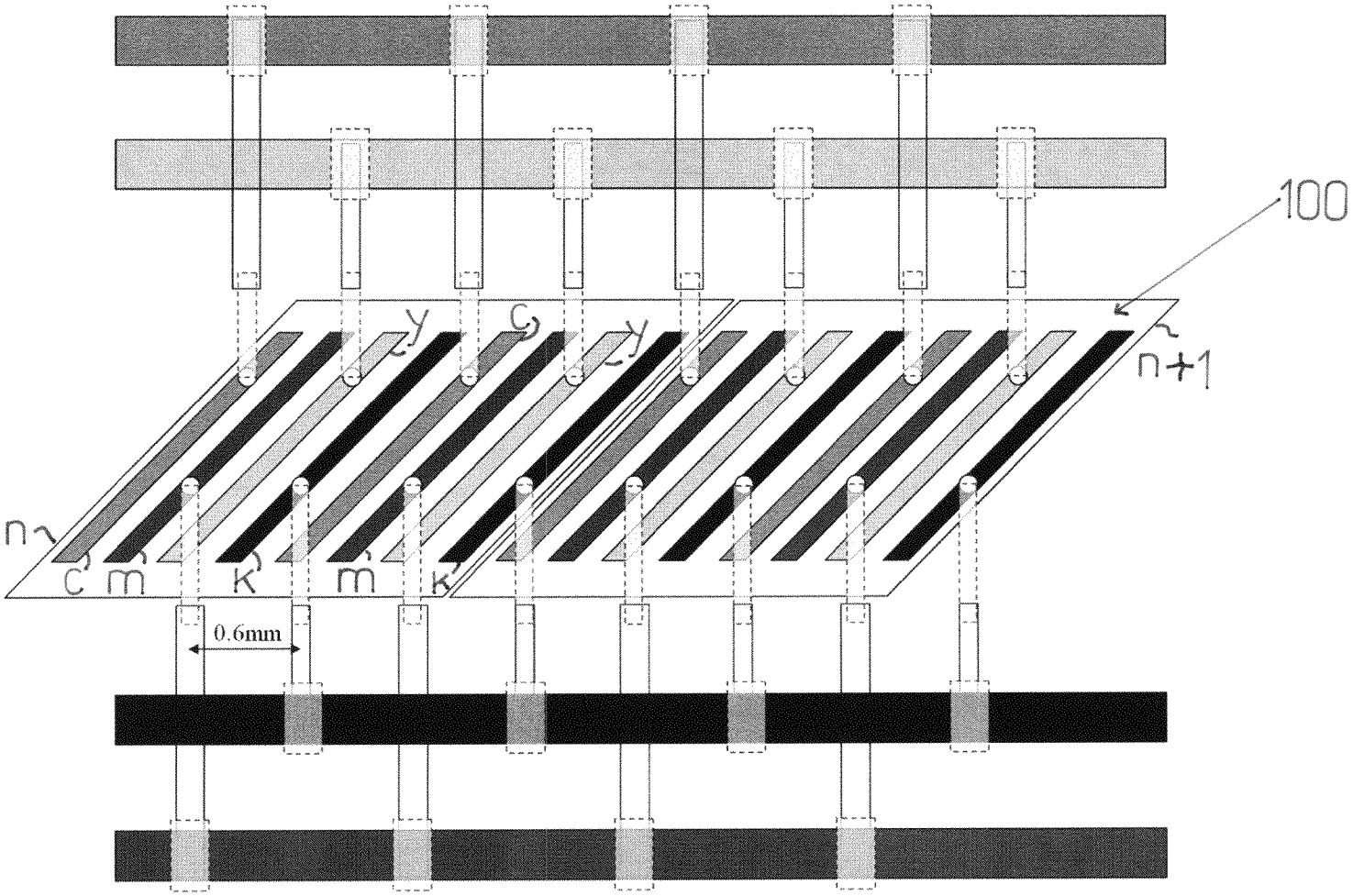
FIGS. 9-10 are diagrammatic views in accordance with the teachings of the present invention showing fluidic connections to skewed vias in ejection chips.
Figure 10:
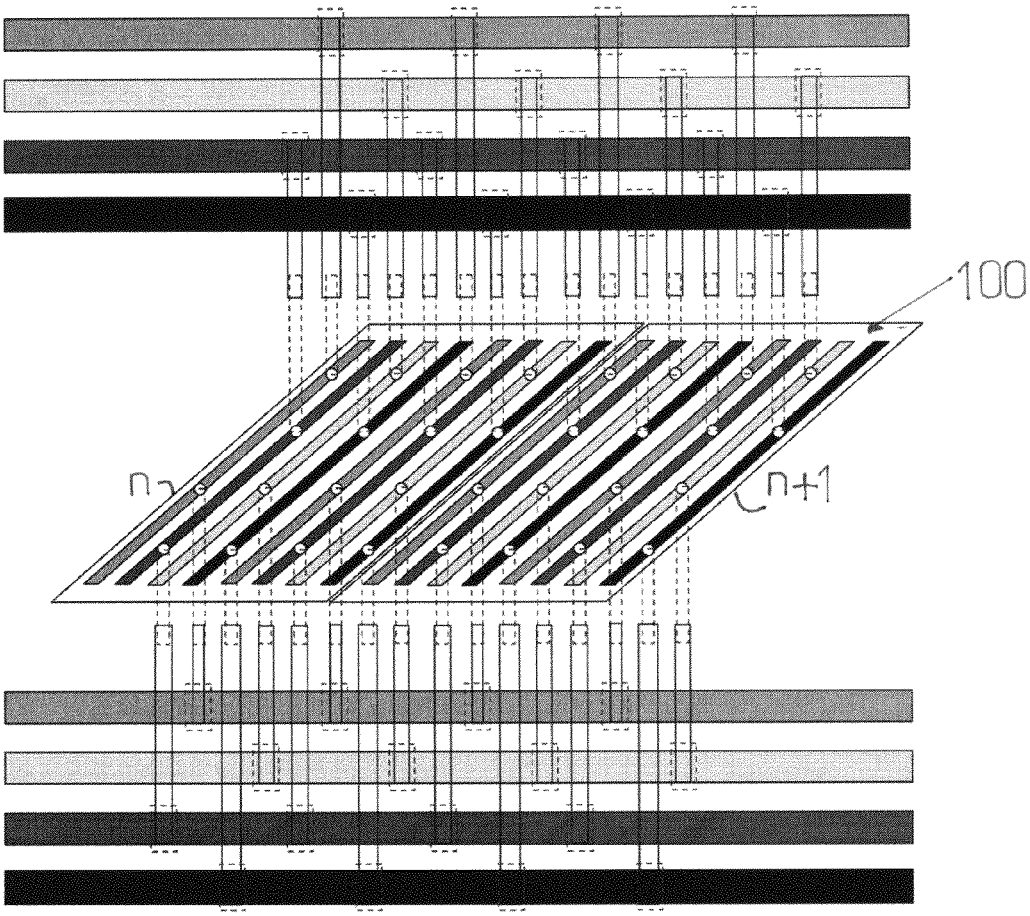

With reference to FIGS. 9 and 10, skilled artisans will appreciate that fluid communication channels need to exist to supply fluid from ink sources (not shown) to the ink vias of the ejection chips. In certain conventional designs, the ejection chips reside above fluidic tiles, in turn, above ceramic substrates. The arrangement fans-out the fluidic channels downward from the chip toward the ceramic and condenses them into a single port connection for each color. Various proposals are described in the Applicant's co-pending U.S. patent application Ser. No. 12/624,078, filed Nov. 23, 2009, and Ser. No. 12/568,739, filed Sep. 29, 2009. Both are incorporated herein by reference. With the applications as background, the current design contemplates feeding respectively colored fluids to a backside 100 of the ejection chips n, n+1 (opposite the side shown in FIG. 1, for instance) as seen. Each chip has a manifold layer at its bottom surface, and the manifold layer has an array of holes separated at 0.6 mm for easy adhesive dispensing/bonding between heater chips and the micro fluidic substrate. The difference between FIGS. 9 and 10 includes micro fluidic connections to chips with and without redundant/secondary nozzles, respectively. Also, the dotted line features indicate a bottom surface of the tile, while the solid lines interconnecting them indicate features at a top surface of the tile.

Relatively apparent advantages should now be readily apparent to skilled artisans. They include, but are not limited to: (1) high mechanical strength ejection chips for at least the reason of shorter ink vias along skew directions; (2) easier power distribution or other signal routing along many spacious "streets" between adjacent ink vias; (3) seamless in-line stitching because of relatively large stitching seal distances; (4) high imaging resolutions with traditional nozzle spacing; and (5) easy silicon fabrication, including traditional dicing techniques.

The foregoing has been presented for purposes of illustrating the various aspects of the invention. It is not intended to be exhaustive or to limit the claims. Rather, it is chosen to provide the best illustration of the principles of the invention and its practical application to enable one of ordinary skill in the art to utilize the invention, including its various modifications that naturally follow. All such modifications and variations are contemplated within the scope of the invention as determined by the appended claims. Relatively apparent modifications, naturally, include combining one or more features of various embodiments with one another.

The invention claimed is:

1. A micro-fluid ejection head, comprising:

a plurality of ejection chips configured adjacently across a media to-be-imaged to create in a first direction a lengthy micro-fluid array, each chip having:

pluralities of fluid vias substantially skewed at an angle relative to the first direction;

pluralities of firing elements that are configured along respective fluid vias of the pluralities of fluid vias;

at least two fluid vias each eject a different color ink and are identically located in a direction perpendicular to the first direction and differently located in the first direction, and wherein a planar periphery of each chip defines a rhomboid and short sides thereof parallel the first direction of the lengthy micro-fluid array, the pluralities of firing elements having at least two firing elements overlapping one another in groupings of like colors along pluralities of ink vias configured for differently-colored inks, the overlapping occurring in the direction perpendicular to the first direction.

2. The ejection head of claim 1, wherein the angle is about forty-five degrees.

3. The ejection head of claim 1, wherein ink vias configured for differently colored inks are configured substantially parallel to one another across the media to-be imaged.

4. The ejection head of claim 1, further including a gap between the adjacently configured ejection chips, wherein edges of the adjacently configured ejection chips substantially parallel one another along the gap.

5. The ejection head of claim 1, wherein adjacent said firing elements are configured in a distance of 1/900th of an inch along one of the fluid vias that is substantially skewed at said angle relative to the first direction.

6. The ejection head of claim 1, wherein a closest firing element to an edge of one of the chips is configured in a stitching seal distance of 0.050 to 0.4 mm.

7. The ejection head of claim 1, wherein the angle is five to eighty-five degrees.

8. The ejection head of claim 1, wherein the fluid vias each have a length in a range of 0.5 to 4 mm.

9. The ejection head of claim 1, wherein the lengthy micro-fluid array in the first direction across the media to-be-imaged is equal to or greater than two inches long.

10. A micro-fluid ejection head, comprising:

a plurality of ejection chips joined adjacently to create a lengthy micro-fluid array in a first direction across a media to-be-imaged, each chip having a periphery substantially defining a parallelogram and at least one edge of each periphery being configured along a gap substantially parallel to an edge of a periphery of an adjoining ejection chip, the gap being skewed at an angle relative to the first direction, each chip further including:

pluralities of ink vias substantially parallel to the edge of the periphery of the adjoining ejection chip;

pluralities of firing elements that are energized to eject fluid during use, the firing elements being configured on said each chip according to ink colors along respective ink vias of the pluralities of ink vias substantially parallel to the edge of the periphery wherein one of the firing elements along a first of the ink vias overlaps one of the firing elements along a second of the ink vias, the overlap occurring in a direction substantially transverse to the first direction; and at least two fluid vias that are identically located in a direction perpendicular to the first direction and differently located in the first direction, and wherein the at least two fluid vias each eject a different color ink.

* * * * *